US012565363B2

(12) United States Patent
Adams

(10) Patent No.: US 12,565,363 B2
(45) Date of Patent: Mar. 3, 2026

(54) BEVERAGE CONTAINER COVER ASSEMBLY

(71) Applicant: Milwaukee Electric Tool Corporation, Brookfield, WI (US)

(72) Inventor: Caleb C. Adams, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 90 days.

(21) Appl. No.: 18/474,502

(22) Filed: Sep. 26, 2023

(65) Prior Publication Data

US 2024/0150090 A1 May 9, 2024

Related U.S. Application Data

(60) Provisional application No. 63/382,636, filed on Nov. 7, 2022.

(51) Int. Cl.
*B65D 47/26* (2006.01)
*A47G 19/22* (2006.01)

(52) U.S. Cl.
CPC ..... *B65D 47/265* (2013.01); *A47G 19/2272* (2013.01); *B65D 2547/063* (2013.01)

(58) Field of Classification Search
CPC .... B65D 47/265; B65D 47/261; B65D 47/26; B65D 43/16; B65D 43/12; B65D 2251/0021; B65D 2313/04; A47G 19/2272; A47G 19/2266; A47G 19/2222
USPC ..... 220/254.4, 254.3, 254.1, 230, 345.6, 220/345.4, 351
See application file for complete search history.

(56) References Cited

U.S. PATENT DOCUMENTS

| | | | |
|---|---|---|---|
| 3,424,334 | A | 1/1969 | Goltz |
| 4,171,060 | A | 10/1979 | Howard et al. |
| 4,712,704 | A | 12/1987 | Ramsey et al. |
| 4,872,569 | A | 10/1989 | Bolte |
| 5,294,014 | A | 3/1994 | Wyatt |
| 5,477,980 | A | 12/1995 | Chaffin |
| 5,657,897 | A | 8/1997 | Schwartzburg |
| 5,711,452 | A | 1/1998 | Chaffin |
| 5,890,613 | A | 4/1999 | Williams |

(Continued)

FOREIGN PATENT DOCUMENTS

| | | |
|---|---|---|
| CN | 203195260 | 9/2013 |
| CN | 203195261 | 9/2013 |

(Continued)

OTHER PUBLICATIONS

Yeti 20 oz Tumbler, https://www.amazon.com/YETI-Rambler-Stainless-Insulated-MagSlider/dp/B073WJMKHN?th=18psc=1, appears to be available at least as early as Jul. 12, 2017, 11 pages.

(Continued)

*Primary Examiner* — Robert J Hicks
(74) *Attorney, Agent, or Firm* — Reinhart Boerner Van Deuren s.c.

(57) ABSTRACT

A lid assembly is provided that is configured to enclose a beverage within a beverage container. The lid assembly includes a lid, a lid cover, and one or more magnetically-interfacing elements that bias the lid and lid cover with respect to each other. To reduce spillage, various embodiments reduce contact between surface(s) of the lid and lid cover, and/or include a gasket the selectively seals a vent.

17 Claims, 9 Drawing Sheets

(56) References Cited

U.S. PATENT DOCUMENTS

| | | | | |
|---|---|---|---|---|
| 6,047,849 | A | 4/2000 | Schwegman et al. | |
| 6,318,683 | B1 | 11/2001 | Savoy | |
| D513,167 | S | 12/2005 | Groff et al. | |
| 6,983,946 | B2 | 1/2006 | Sullivan et al. | |
| D526,851 | S | 8/2006 | Groff et al. | |
| D565,352 | S | 4/2008 | Williams | |
| 8,360,258 | B2 | 1/2013 | Gilbert et al. | |
| 8,464,895 | B2 | 6/2013 | Gilbert et al. | |
| 8,573,431 | B2 | 11/2013 | Shepard et al. | |
| 8,740,010 | B1 | 6/2014 | Page | |
| 8,746,496 | B2 | 6/2014 | Gilbert et al. | |
| 8,757,418 | B2 | 6/2014 | Zimmerman | |
| 9,351,596 | B2 | 5/2016 | Karam | |
| 9,375,107 | B2 | 6/2016 | Gilbert et al. | |
| 9,375,835 | B1 | 6/2016 | Lin | |
| D796,265 | S | 9/2017 | Lapsker | |
| 10,023,366 | B2 | 7/2018 | Gilbert et al. | |
| 10,035,629 | B2 | 7/2018 | Gilbert et al. | |
| 10,071,838 | B2 | 9/2018 | Gilbert et al. | |
| 10,077,144 | B2 | 9/2018 | Gilbert et al. | |
| 10,124,942 | B2 | 11/2018 | Seiders et al. | |
| 10,227,166 | B2 | 3/2019 | Gilbert et al. | |
| 10,232,987 | B2 | 3/2019 | Gilbert et al. | |
| 10,232,992 | B2 | 3/2019 | Seiders et al. | |
| 10,232,993 | B2 | 3/2019 | Seiders et al. | |
| D851,998 | S | 6/2019 | O'Nan et al. | |
| 10,329,061 | B2 | 6/2019 | Dias et al. | |
| 10,421,587 | B2 | 9/2019 | Gilbert et al. | |
| 10,750,833 | B2 | 8/2020 | Burchia | |
| 10,870,522 | B2 | 12/2020 | Lane | |
| 11,213,146 | B1 | 1/2022 | Sletten | |
| 2002/0092851 | A1* | 7/2002 | Belcastro | A47G 19/2272 220/823 |
| 2003/0139080 | A1 | 7/2003 | Lafragette et al. | |
| 2005/0079011 | A1 | 4/2005 | Groff et al. | |
| 2005/0189361 | A1 | 9/2005 | Bresler | |
| 2006/0283859 | A1 | 12/2006 | Lu | |
| 2007/0138041 | A1 | 6/2007 | Welsh | |
| 2009/0001090 | A1 | 1/2009 | Karam | |
| 2011/0260588 | A1 | 10/2011 | Lin | |
| 2013/0127129 | A1 | 5/2013 | Bensman et al. | |
| 2014/0265440 | A1 | 9/2014 | Chen et al. | |
| 2018/0127165 | A1 | 5/2018 | Smaldone et al. | |
| 2019/0152661 | A1 | 5/2019 | Seiders et al. | |
| 2019/0389632 | A1 | 12/2019 | Isengingo | |
| 2020/0039706 | A1 | 2/2020 | Gilbert et al. | |
| 2020/0231345 | A1 | 7/2020 | Lane et al. | |
| 2020/0331670 | A1 | 10/2020 | Seiders et al. | |
| 2020/0331671 | A1 | 10/2020 | Seiders et al. | |
| 2020/0361672 | A1 | 11/2020 | Jinkins et al. | |
| 2020/0377273 | A1 | 12/2020 | Seiders et al. | |
| 2021/0345805 | A1 | 11/2021 | Keast et al. | |
| 2021/0354889 | A1 | 11/2021 | Wong et al. | |
| 2022/0354283 | A1 | 11/2022 | Schneider | |
| 2022/0361694 | A1* | 11/2022 | Forsyth | A47G 19/2272 |
| 2022/0363452 | A1* | 11/2022 | Jinkins | B65D 47/286 |

FOREIGN PATENT DOCUMENTS

| | | | |
|---|---|---|---|
| CN | 203969968 | | 12/2014 |
| CN | 204580762 | | 8/2015 |
| CN | 105147013 | | 3/2017 |
| CN | 106805661 | | 6/2017 |
| CN | 107874548 | | 4/2018 |
| CN | 108771431 | | 11/2018 |
| CN | 106724563 | | 2/2019 |
| CN | 110279295 | | 9/2019 |
| CN | 210055531 | | 2/2020 |
| CN | 210446545 | | 5/2020 |
| CN | 210540511 | | 5/2020 |
| CN | 210697021 | | 6/2020 |
| CN | 211093209 | | 7/2020 |
| CN | 111631575 | | 9/2020 |
| CN | 212186046 | | 12/2020 |
| DE | 202014103695 | | 12/2014 |
| DE | 102016215239 | | 2/2017 |
| EP | 1724069 | A2 | 11/2006 |
| EP | 2537641 | B1 | 9/2016 |
| EP | 2338650 | B1 | 10/2016 |
| GB | 2211486 | | 7/1989 |
| WO | WO2014/125484 | | 8/2014 |
| WO | WO2022/236025 | | 11/2022 |

OTHER PUBLICATIONS

HydroFlask 28 oz Tumbler, https://www.hydroflask.com/28-oz-all-around-tumbler, appears to be available at least as early as Jan. 30, 2022, 4 pages.

Milwaukee Tool 20 oz Tumbler, https://www.homedepot.com/p/Milwaukee-PACKOUT-Red-20-oz-Tumbler-48-22-8392R/319631649, appears to be available at least as early as May 11, 2022, 5 pages.

* cited by examiner

BEVERAGE CONTAINER COVER ASSEMBLY

CROSS-REFERENCE TO RELATED PATENT APPLICATION

The present application claims the benefit of and priority to U.S. Application No. 63/382,636 filed on Nov. 7, 2022, which is incorporated herein by reference in its entirety.

BACKGROUND OF THE INVENTION

The present disclosure is directed generally to containers and related devices. The present disclosure relates specifically to a lid assembly for a beverage container.

Beverage containers are often used to transport beverages for consumption. Beverage containers often include a cover or a lid that encloses the beverage within the container.

SUMMARY OF THE INVENTION

One embodiment of the invention relates to a drinking container including a bottom panel that defines a bottommost surface, an axis around which the bottom panel is centered, a wall extending upwardly from the bottom panel, a lid coupled to the wall, a lid cover rotatably engaged with the lid, and a biasing element coupled to at least one of the lid and the lid cover, the biasing element biasing the lid cover from transitioning from the closed position to the open position with respect to the lid. The wall extends around the axis, and the wall and bottom panel collectively partially define a storage compartment. The wall defines an upper opening opposite the bottom panel. The lid partially covers the upper opening. The lid defines a drinking opening smaller than the upper opening. The lid includes a first projection that extends upward away from the bottom panel, and the first projection extends circumferentially around and is centered on the axis. When the lid cover is in a closed position the lid cover occludes the drinking opening, and when the lid cover is in an open position the drinking opening provides fluid communication between the storage compartment and an exterior of the drinking container. The lid cover includes a first recess circumferentially extending around the axis, and the first recess receives the first projection.

Another embodiment of the invention relates to a drinking container including a bottom panel that defines a bottommost surface, an axis around which the bottom panel is centered, a wall extending upwardly from the bottom panel, the wall defining an upper opening opposite the bottom panel, a lid coupled to the wall and partially covering the upper opening, a lid cover rotatably coupled to the lid, a biasing element coupled to at least one of the lid and the lid cover, the biasing element biasing the lid cover from transitioning from the closed position to the open position with respect to the lid. The wall extends around the axis, and the wall and bottom panel collectively partially define a storage compartment. The lid defines a drinking opening smaller than the upper opening, and the lid defines an inner surface that faces inward towards the axis. The lid includes an outer surface that faces outward away from the axis, the outer surface and inner surface facing towards each other. The lid cover actuates between an open position and a closed position with respect to the lid. When the lid cover is in the closed position the lid cover occludes the drinking opening, and when the lid cover is in the open position the drinking opening provides fluid communication between the storage compartment and an exterior of the drinking container. The outer surface and the inner surface do not interface when the lid cover is rotated with respect to the lid.

Another embodiment of the invention relates to a drinking container including a bottom panel that defines a bottommost surface, an axis around which the bottom panel is centered, a wall extending upwardly from the bottom panel, the wall defining an upper opening opposite the bottom panel, a lid coupled to the wall and partially covering the upper opening, a first magnetically-responsive element coupled to the lid, a lid cover rotatably coupled to the lid, a second magnetically-responsive element coupled to the lid cover, and a gasket. The wall extends around the axis, and the wall and bottom panel collectively partially define a storage compartment. The lid defines a drinking opening smaller than the upper opening, and the lid defines a vent that provides fluid communication with the storage compartment. The lid cover actuates between an open position and a closed position with respect to the lid. When the lid cover is in the closed position the lid cover occludes the drinking opening, and when the lid cover is in the open position the drinking opening provides fluid communication between the storage compartment and an exterior of the drinking container. Magnetic engagement between the first magnetically-responsive element and the second magnetically-responsive element biases the lid cover from transitioning from the closed position to the open position. The gasket is coupled to one of the lid or the lid cover. The gasket engages with the other of the lid or the lid cover when the lid cover is positioned in the closed position with respect to the lid, and the gasket blocks fluid communication between the vent and the storage compartment when the lid cover is in the closed position.

Another embodiment of the invention relates to a drinking container including a bottom panel that includes a bottommost surface, an axis around which the bottom panel is centered, a wall that extends upwardly from the bottom panel, the wall and bottom panel collectively defining a liquid-storage area, the wall defining an upper opening opposite the bottom panel, a lid coupled to the wall and covering the upper opening, a first magnetically-responsive element coupled to the lid, a lid cover rotatably coupled to the lid, and a second magnetically-responsive element coupled to the lid cover. The lid defines a drinking opening smaller than the upper opening, and the lid includes an inner surface that faces inward towards the axis. The lid cover includes an outer lateral surface that faces outward away from the axis and towards the inner surface of the lid. The lid cover actuates between an open position and a closed position with respect to the lid. When the lid cover is in the closed position the lid cover occludes the drinking opening, and when the lid cover is in the open position the drinking opening provides fluid communication between the liquid-storage area and an exterior of the drinking container. The outer surface and the inner surface do not interface when the lid cover is rotated with respect to the lid. Magnetic engagement between the first magnetically-responsive element and the second magnetically-responsive element biases the lid cover from transitioning from the closed position to the open position.

In various embodiments, the lid includes one or more projections that extend upward and circumferentially extend around the axis, and the lid cover includes one or more recesses that circumferentially extend around the axis. The one or more recesses receive the one or more projections.

In various embodiments, the lid includes a vent that selectively provides fluid communication between the liquid-storage area and the exterior of the drinking container, and the drinking container includes a gasket coupled to one of the lid or the lid cover, the gasket engaging with the other of the lid or the lid cover when the lid cover is positioned in the closed position with respect to the lid. In various embodiments, one of the lid or the lid cover includes a recess that receives the gasket when the lid cover is positioned in the open position with respect to the lid. The recess and the vent collectively provide fluid communication between the liquid-storage area and the exterior of the drinking container when the lid cover is positioned in the open position with respect to the lid.

Additional features and advantages will be set forth in the detailed description which follows, and, in part, will be readily apparent to those skilled in the art from the description or recognized by practicing the embodiments as described in the written description included, as well as the appended drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments. In addition, alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of a lid and lid cover for a beverage container are shown. The lid and lid cover are designed to selectively actuate between an open position and a closed position. In the open position, the beverage is accessible, for example, for a user to drink. In the closed position, the beverage is enclosed within the beverage container, thereby protecting the beverage from spilling out of the container.

Various embodiments of the lids and lid covers described herein are configured to reduce, minimize or even eliminate spillage and splashing of liquid from the container. In various embodiments, the lid and/or lid cover include a gasket that seals a vent when the lid and lid cover are in a closed configuration, thereby reducing an amount of liquid that can spill. In various embodiments, the lid and lid cover include interface elements, such as curved protrusions and recesses that receive the protrusions, that reduce an amount of splashing of liquid when the lid cover is rotated with respect to the lid. In various embodiments, the lids are configured to couple to a beverage container that couples to a cleat in a Milwaukee PACKOUT® modular storage unit.

Figure 1:
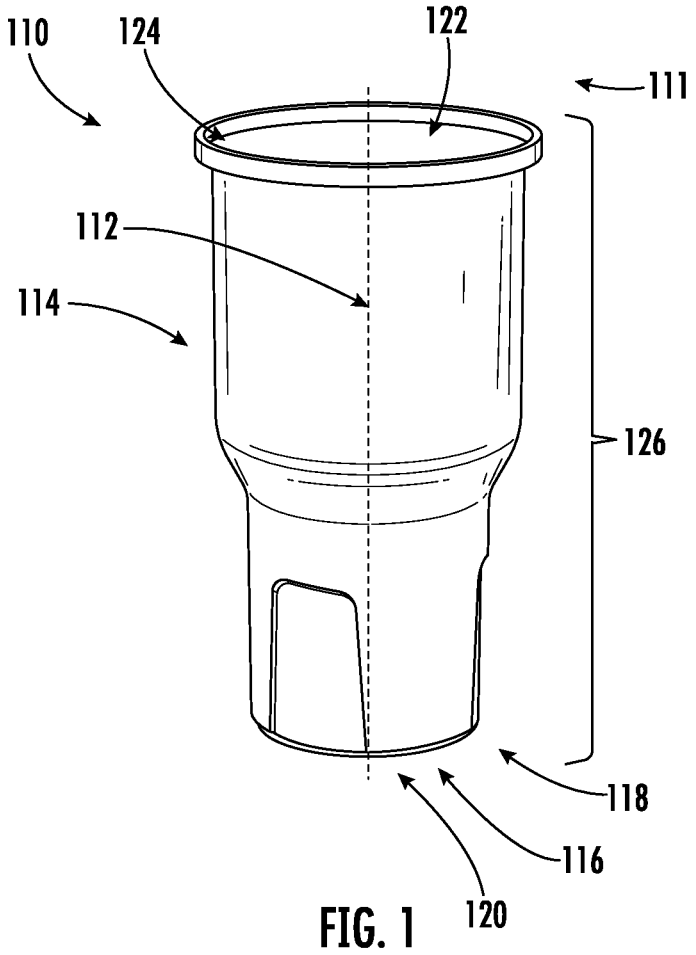
FIG. 1 is a perspective view of a beverage container, according to an exemplary embodiment.
Figure 2:
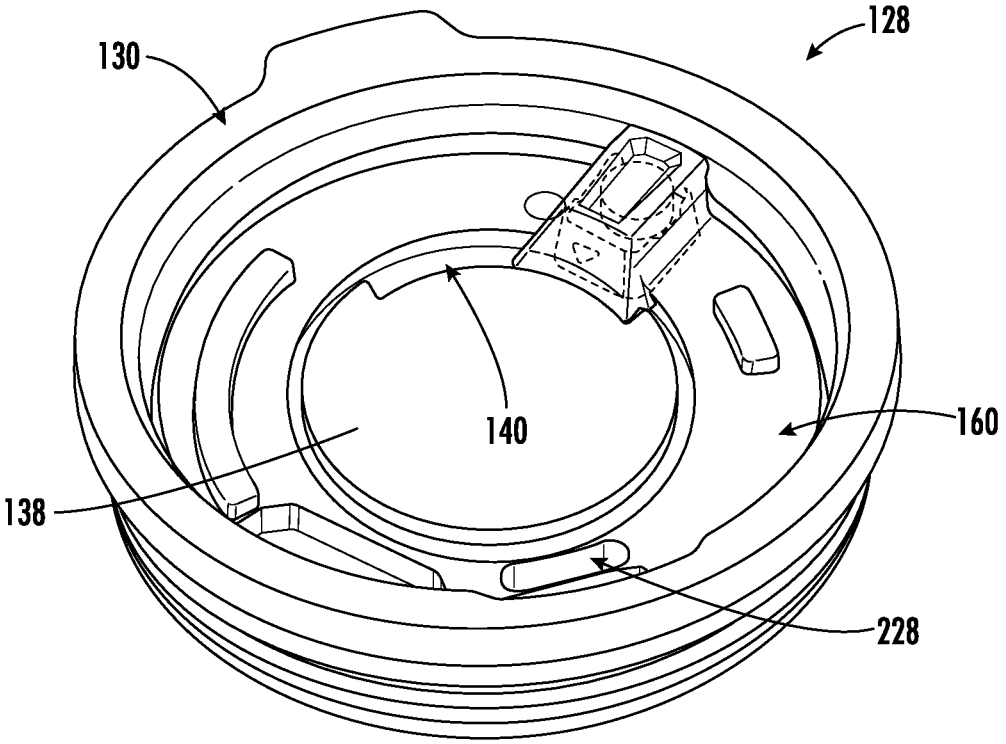
FIG. 2 is a perspective view of a lid assembly for a beverage container in a closed position, according to an exemplary embodiment.

Referring to FIG. 1, a drinking container, unit and/or device, such as beverage container 110, is shown according to an exemplary embodiment. In various embodiments, beverage container 110 includes bottom panel 118, a wall 114, such as a cylindrical wall, lid 130, and lid cover 180 coupled to the lid 130, and biasing element 127. In various embodiments, beverage container 110 includes body 126 that includes bottom panel 118 and wall 114, and body 126 defines storage compartment 122 and upper opening 124. Lid 130 is coupled to the wall 114 and/or body 126 (e.g., via wall 114) and partially covers upper opening 124. Each of the lid 130 and lid cover 180 include one or more magnetically-responsive elements (e.g., magnets and/or ferrous metals). Bottom panel 118 of container 110 defines a bottom-most surface 120 of container 110. An enclosing element, shown as wall 114, extends upwardly from bottom panel 118, and wall 114 extends around axis 112, such as circumferentially around axis 112. Wall 114 and bottom panel 118 collectively partially define a storage area, shown as storage compartment 122. In various embodiments one or more of body 126, wall 114, bottom panel 118, lid 130 and/or lid cover 180 are centered on axis 112 (e.g., bottom panel 118 is centered on axis 112).

Biasing element 127 is coupled to at least one of the lid 130 and lid cover 180. Biasing element 127 biases lid cover 180 from transitioning from a closed position to an open position with respect to the lid 130. In various embodiments, biasing element 127 includes one or more magnetically responsive elements, shown as ferrous metal 156, magnet 158, and magnet 190. Magnetic engagement between the ferrous metal 156 and the magnet 190 biases lid cover 180 from transitioning from the closed position to the open position with respect to lid 130.

In various embodiments, magnet 158 is coupled to one of lid cover 180 and lid 130, and magnetic engagement between the magnet 158 and magnet 190 biases the lid cover 180 from transitioning from the open position to the closed position. In various embodiments, magnet 158 is coupled to lid 130.

Wall 114 extends upwardly from bottom panel 118. Wall 114 defines upper opening 124 opposite bottom panel 118. One or more of lids described herein are configured to couple to wall 114 at upper opening 124, thereby fully or mostly enclosing storage compartment 122. For example, lid 130 is coupled to wall 114 and partially covers the upper opening 124, and the lid 130 defines a drinking opening 132 smaller than the upper opening 124. In a specific embodiment, one or more of bottom panel 118, walls 114, and upper opening 124 are centered on axis 112.

In a specific embodiment, coupling component 116 extends from and/or along bottom panel 118. In a specific embodiment, coupling component 116 is compatible with the coupling mechanism(s) described in International Patent Publication No. WO 2017/191628, which is incorporated herein by reference in its entirety.

One or more lids described herein are configured to reversibly and detachably engage and disengage with wall 114, such as at upper opening 124 of wall 114. In various embodiment, the lids described herein engage with a beverage container via an interference fit.

Referring to FIGS. 2-7, a lid assembly 128 is shown according to an exemplary embodiment. Lid assembly 128 includes lid 130 and lid cover 180. Lid cover 180 is rotatably engaged and slidably engaged with lid 130. Lid cover 180 rotatably actuates between an open position and a closed position (FIG. 3) with respect to the lid 130.

In various embodiments, beverage lid cover 180 includes plug 228 (FIG. 2) coupled to apertures 224. In various embodiments, plug 228 extends through apertures 224 to bias lid cover 180 away from lid 130.

Figure 3:
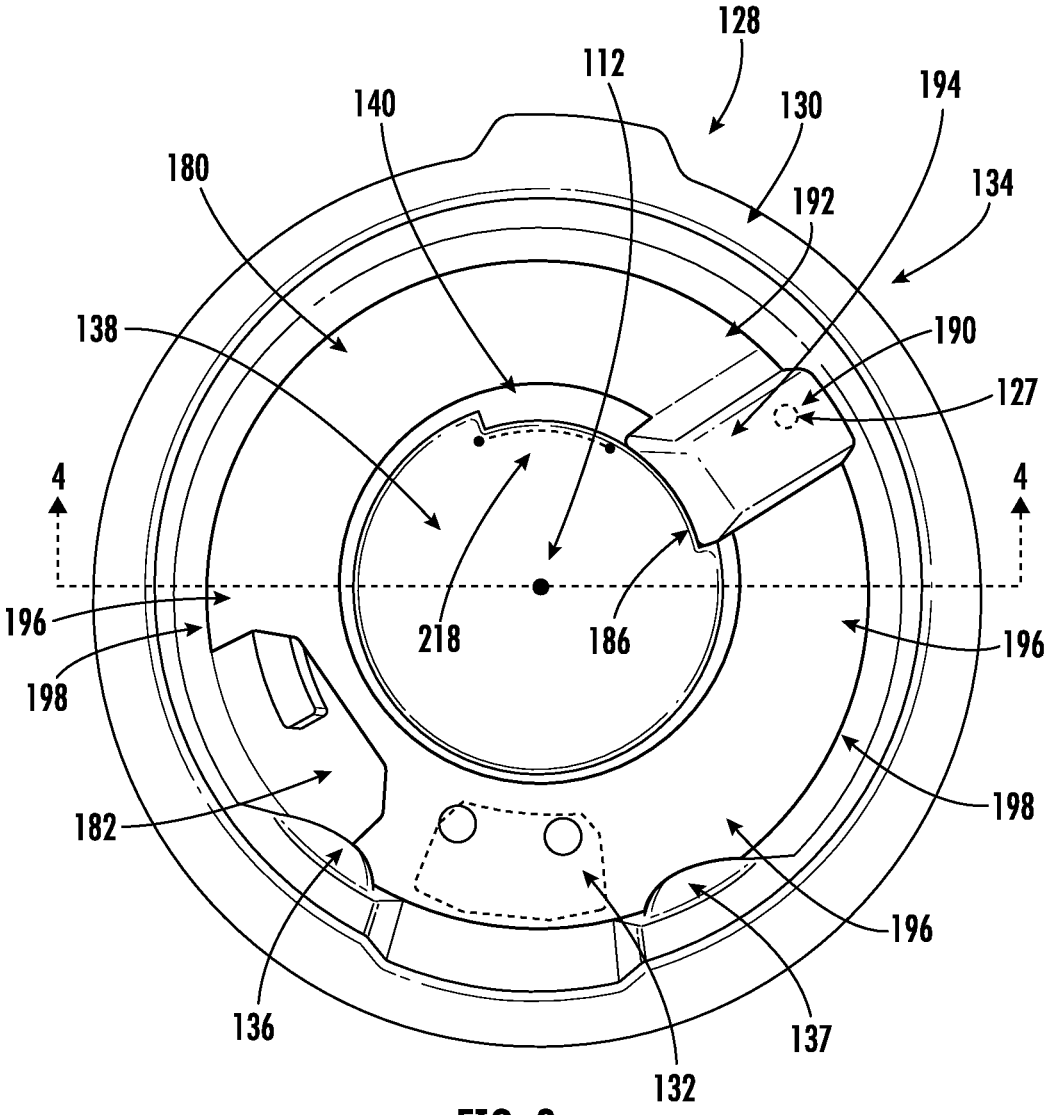
FIG. 3 is a top view of the lid assembly of FIG. 2, according to an exemplary embodiment.

Referring to FIG. 3, in various embodiments lid cover 180 includes upwardly-extending projection 194 that extends upward from the body 192 of lid cover 180 above upper surface 196 of body 192, the upwardly-extending projection 194 being configured to interface with a user actuating the lid cover 180 between the open position and the closed position. When lid cover 180 is in a closed position, the lid cover 180 occludes the drinking opening 132 of lid 130, and when lid cover 180 is in an open position the drinking opening 132 of lid 130 provides fluid communication between the storage compartment 122 and an exterior 111 of the drinking container 110. In various embodiments lid 130 and lid cover 180 are coupled to a top of a beverage container (e.g., container 110), thereby enclosing a beverage stored within the beverage container.

Referring to FIG. 3, in various embodiments, lid 130 includes one or more projections, shown as ears 136, 137, that extend radially inward from annular wall 134 towards axis 112. In a specific embodiment, lid 130 includes a projection, shown as ear 136, that extends inwardly towards axis 112. Ears 136, 137 at least partially secure lid cover 180 to lid 130. In various embodiments, upper surface 196 of lid cover 180 interfaces with ears 136, 137 to secure lid cover 180 to lid 130. In various embodiments, engagement between ear 136 and lid cover 180 biases lid cover 180 towards bottom panel 118.

In the closed position (FIG. 3), drinking opening 132 of lid 130 and drinking opening 182 of lid cover 180 are rotated out of alignment, thereby enclosing the storage compartment 122 of the beverage container. In the closed position, the beverage is sealed within the storage compartment 122 of the beverage container, thereby reducing and/or minimizing the ability of the beverage to leak out of the storage compartment 122 of the beverage container 110.

Lid 130 includes a curved recess, shown as arcuate-shaped recess 140, within projection 138. The arcuate-shaped recess 140 is defined by a reduced diameter section of projection 138 that extends circumferentially around a portion of lid 130 and is centered around axis 112. In various embodiments, recess 140 extends circumferentially around axis 112.

Referring to FIG. 3, lid cover 180 includes body 192, which extends circumferentially around axis 112. Lid cover 180 includes projection 186, which extends radially inward from body 192 towards axis 112 into recess 140. As lid cover 180 actuates between the open and closed positions with respect to lid 130, projection 186 rotates within recess 140 of lid 130.

Lid cover 180 rotates angle 218 relative to (e.g., with respect to) lid 130 around axis 112. In various embodiments, angle 218 is between 25 degrees and 100 degrees, and more specifically is between 35 degrees and 75 degrees, and more specifically is between 45 degrees and 58 degrees, and more specifically is 50 degrees.

A magnetically-responsive component, shown as magnet 190, is coupled to lid cover 180. In a specific embodiment, magnet 190 is rigidly coupled to lid cover 180, such as via magnet 190 being embedded within lid cover 180. As will be described, magnet 190 biases lid cover 180 to remain stationary with respect to lid 130. In various embodiments, magnet 190 includes a plurality of magnets (e.g., stacked magnets).

Figure 4:
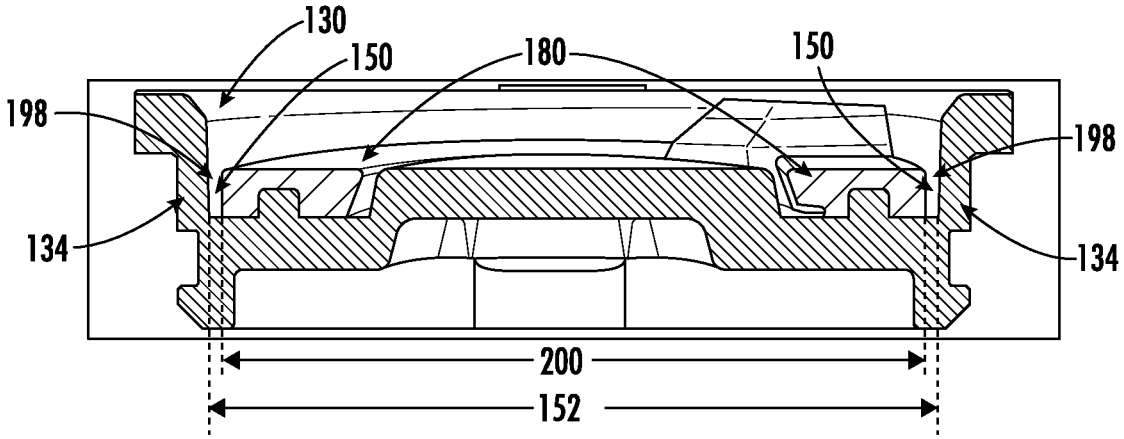
FIG. 4 is a cross section view of the lid assembly of FIG. 3 taken along line 4-4 in FIG. 3, according to an exemplary embodiment.
Figure 5:
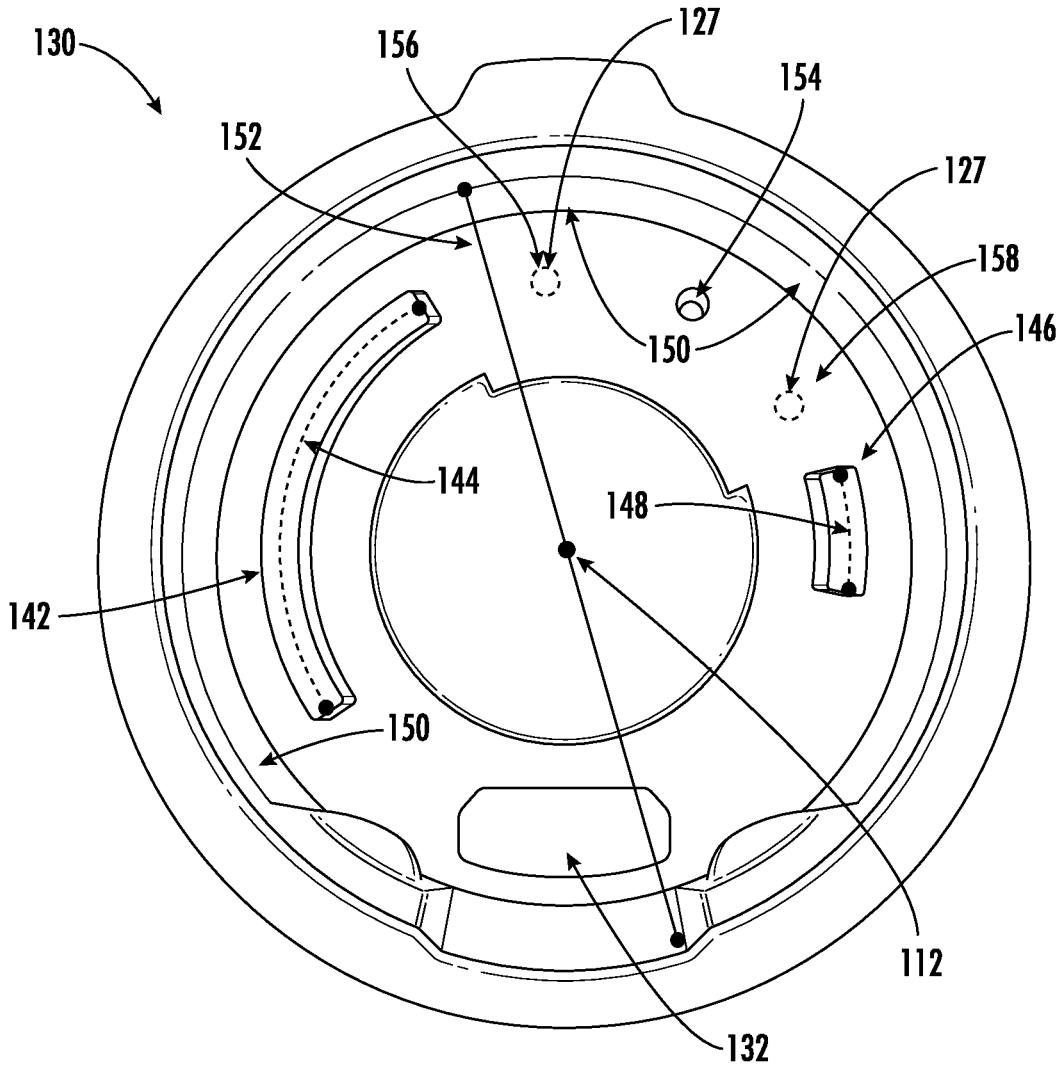
FIG. 5 is a top view of the lid of FIG. 2, according to an exemplary embodiment.

Referring to FIGS. 4-5, lid 130 includes inner wall 149 that extends peripherally around lid 130. Inner wall 149 includes an inner surface 150 that faces inwards towards the lid cover 180 when the lid cover 180 is seated within lid 130. Inner surface 150 defines a diameter 152. Diameter 152 of inner surface 150 of lid 130 is greater than diameter 200 of lid cover 180 such that outer lateral surface 198 of lid cover 180 and inner surface 150 do not interface when lid cover 180 is rotating with respect to lid 130. Applicant has observed that reducing contact between outer lateral surface 198 of lid cover 180 and inner surface 150 of lid 130 reduces and/or eliminates splashing of liquid resting on lid 130 when lid cover 180 is rotated with respect to lid 130.

Referring to FIG. 5, lid 130 includes vent 154. Vent 154 provides fluid communication for air to enter storage compartment 122 when the user is drinking liquid through openings 132, 182, thereby reducing how much air enters storage compartment 122 through openings 132, 182 when the user is drinking from container 110, which may interfere with the even flow of liquid through openings 132, 182. In various embodiments, lid includes upper wall 160 extending perpendicular to axis 112, and one or more of first projection 142 and second projection 146 extend upward from upper wall 160. In various embodiments, lid 130 includes wall 134 extending upward from upper wall 160 away from bottom panel 118, wall 134 defining inner surface 150 that faces inward towards the axis 112.

Referring to FIG. 5, in various embodiments a first magnetically-responsive component, shown as ferrous metal 156, is coupled to lid 130, and a second magnetically-responsive component, shown as magnet 158, is coupled to lid 130. In a specific embodiment, ferrous metal 156 and/or magnet 158 are rigidly coupled to lid 130, such as via being embedded within lid 130. As lid cover 180 actuates with respect to the lid 130 between the open and closed positions, magnet 190 of lid cover 180 magnetically engages with either ferrous metal 156 (open position) or magnet 158 (closed position). In various embodiments, the ferrous metal 156 includes or consists of steel (e.g., ferrous metal 156 is formed from steel). In the closed position (FIG. 3), magnet 190 of lid cover 180 is magnetically engaged with magnet 158. Because of this engagement, lid cover 180 is biased from transitioning from the closed position into the open position.

Referring to FIG. 5, lid 130 includes first projection 142 and second projection 146, each of which extend upward away from bottom panel 118 when lid 130 is coupled to container 110. In various embodiments, first projection 142 and/or second projection 146 define curves that circumferentially extend around axis 112. In various embodiments, first projection 142 and/or second projection 146 define partial cylinders that circumferentially extend around axis 112. First projection 142 and/or second projection 146 extend circumferentially around and are centered on axis 112. First projection 142 circumferentially extends an arc length defined by angle 144 around axis 112, and second projection 146 circumferentially extends an arc length defined by angle 148 around axis 112. In various embodiments, second projection 146 is distinct from first projection 142 and extends upward away from bottom panel 118.

Figure 6:
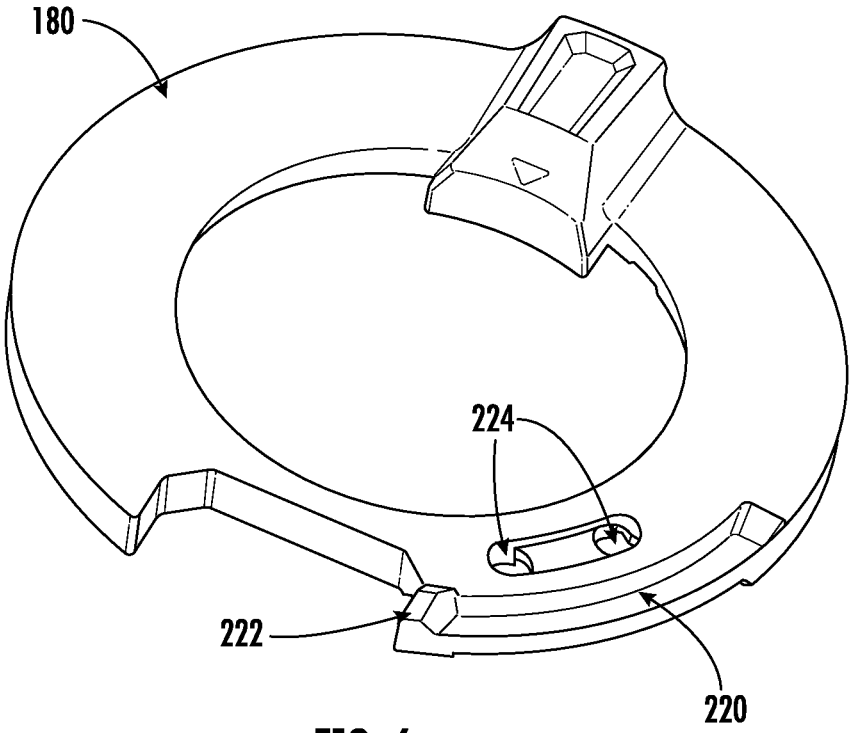
FIG. 6 is a perspective view of the lid cover of FIG. 2, according to an exemplary embodiment.

Referring to FIG. 6, lid cover 180 includes projection 222 extending upward away from lid 130. When lid cover 180 is in the open position with respect to lid 130, projection 222 interfaces with right ear 137 to bias lid cover 180 towards lid 130, thereby increasing the seal between lid cover 180 and lid 130.

Recess 220 extends circumferentially around an outer portion of lid cover 180. When lid cover 180 transitions from the closed position to the open position with respect to lid 130, recess 220 receives right ear 137, thereby facilitating rotating lid cover 180 with respect to lid 130.

Figure 7:
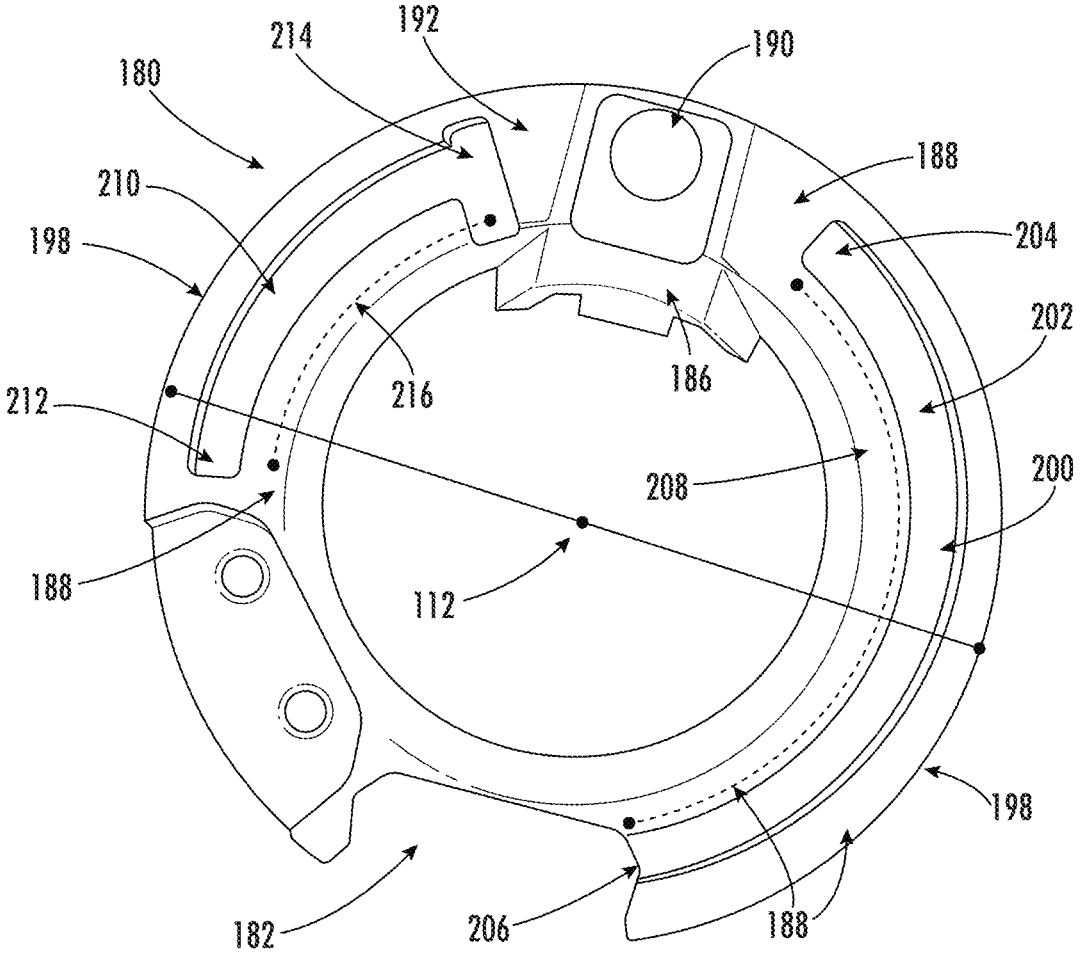
FIG. 7 is a bottom view of the lid cover of FIG. 2, according to an exemplary embodiment.

Referring to FIG. 7, various aspects of a bottom of lid cover 180 are shown. Lid cover 180 includes first recess 202 within lower surface 188, which extends circumferentially angle 208 around lid cover 180 with respect to axis 112 from first end 204 to second end 206. In various embodiments, lid cover 180 includes first recess 202 that circumferentially extends around axis 112 and receives first projection 142. Lid cover 180 includes second recess 210 within lower surface 188, and second recess 210 extends circumferentially around lid cover 180 with respect to axis 112 from first end 212 to second end 214 (e.g., second recess 210 circumferentially extends around a portion of lid cover 180 with respect to axis 112). Second recess 210 has an arc length defined by angle 216. In various embodiments, second recess 210 circumferentially extend around axis 112 and the second recess 210 receives second projection 146.

Lid cover 180 defines diameter 200. As explained above, in various embodiments diameter 200 of lid cover 180 is sufficiently smaller than diameter 152 of lid 130 such that lateral surface 198 of lid cover 180 and inner surface 150 of lid 130 have reduced, minimal, or even no interface with each other when lid cover 180 is rotated with respect to lid 130. Instead, the contact between first and second projections 142, 146 and first and second recesses 202, 210 maintain the positioning of lid cover 180 with respect to lid 130, thereby reducing or eliminating the amount of interface between lateral surface 198 of lid cover 180 and inner surface 150 of lid 130 when lid cover 180 is rotated with respect to lid 130. Applicant has observed that reducing contact between outer lateral surface 198 of lid cover 180 and inner surface 150 of lid 130 reduces and/or eliminates splashing of liquid resting on lid 130 when lid cover 180 is rotated with respect to lid 130.

Figure 9:
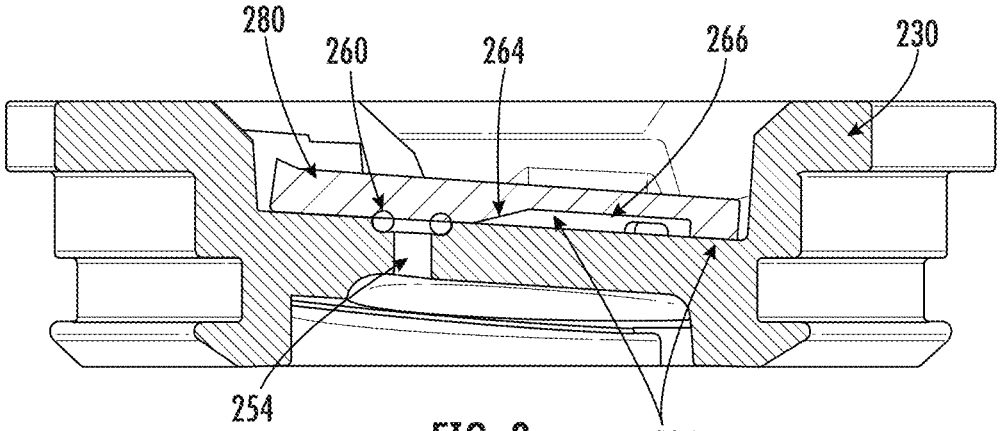
FIG. 9 is a cross-section view of the lid and lid cover of FIG. 8, according to an exemplary embodiment.
Figure 10:
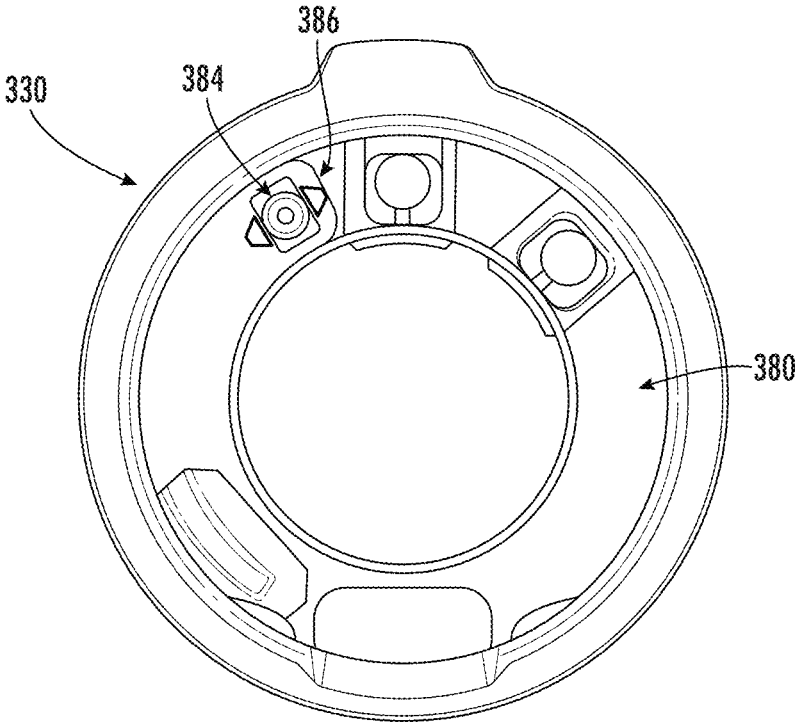
FIG. 10 is a top view of a lid and lid cover, according to another exemplary embodiment.
Figure 11:
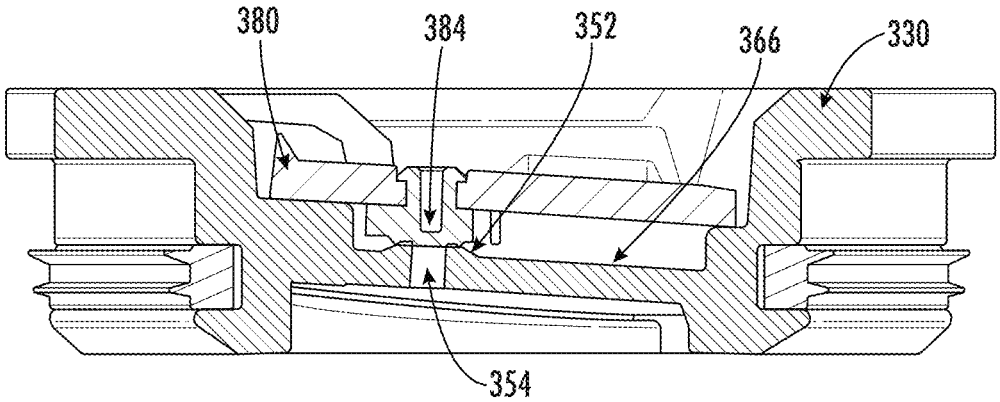
FIG. 11 is a cross-section view of the lid and lid cover of FIG. 10, according to an exemplary embodiment.

In various embodiments, lid assembly 128 includes the vent sealing mechanisms, such as gasket 260 and/or gasket 384, in one of lid 230 or lid cover 280 (FIGS. 8-9) or the vent sealing mechanisms in one of lid 330 or lid cover 380 (FIGS. 10-11).

Figure 8:
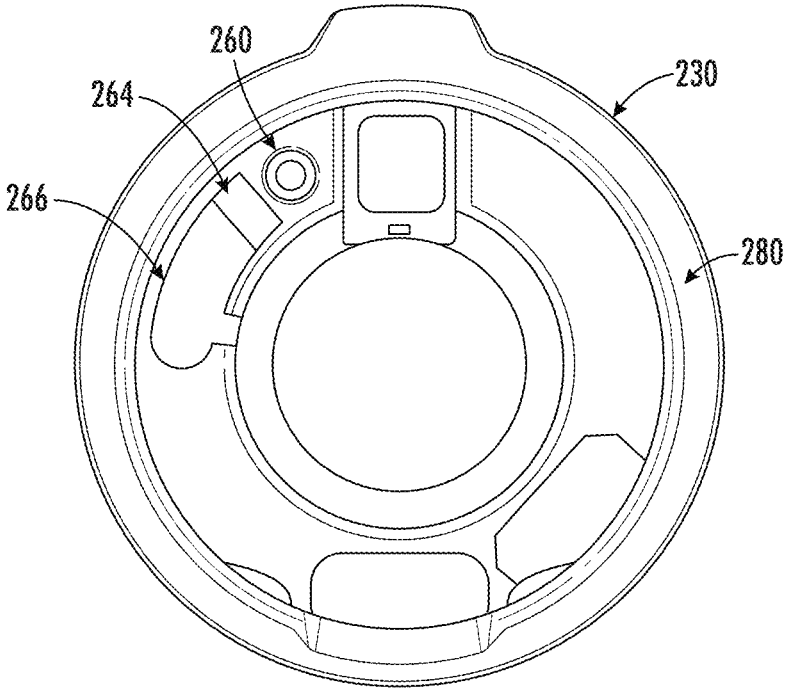
FIG. 8 is a top view of a lid and lid cover, according to another exemplary embodiment.

Referring to FIGS. 8-9, lid 230 and lid cover 280 are shown according to exemplary embodiments. Lid 230 is substantially the same as lid 130 except for the differences discussed herein, and lid cover 280 is substantially the same as lid cover 180 except for the differences discussed herein. In particular, lid 230 includes gasket 260, which is configured to engage with lid cover 280, thereby sealing vent 254, when lid cover 280 is positioned in the closed configuration with respect to lid 230. In various embodiments, gasket 260 is coupled to one of lid 230 or lid cover 280 and engages the other of the lid 230 or the lid cover 280 when the lid cover 280 is positioned in the closed position with respect to the lid 230. In various embodiments, gasket 260 blocks fluid communication between the vent 254 and the storage compartment of the container (e.g., storage compartment 122 of container 110) when the lid cover 280 is in the closed position.

In use, when lid cover 280 is positioned in the closed configuration with respect to lid 230 (FIG. 7), gasket 260 sealingly engages lower surface 284 of lid cover 280 to reduce and/or eliminate fluid communication between storage compartment 122 and outside the container 110 via vent 254. When lid cover 280 is positioned in the open configuration with respect to lid 230, gasket 260 is positioned within pocket 266. As a result, gasket 260 is not interfacing lower surface 284 of lid cover 280, and therefore vent 254 provides fluid communication between storage compartment 122 and outside the container 110 via vent 254 (e.g., to permit air to transit vent 254 into storage compartment 122 when the user is drinking liquid). Ramp 264 helps press gasket 260 closed when the lid cover 280 is in the closed position with respect to lid 230.

Referring to FIGS. 10-11, lid 330 and lid cover 380 are shown according to exemplary embodiments. Lid 330 is substantially the same as lid 130 or lid 230 except for the differences discussed herein, and lid cover 380 is substantially the same as lid cover 180 or lid cover 280 except for the differences discussed herein.

Lid 330 includes vent 354 and a ramp 352 (e.g., an elevated surface around vent 354). When lid cover 380 is in the closed configuration with respect to lid 330, gasket 384 coupled lid cover 380 engages with vent 354 to seal vent 354. When lid cover 380 is in the open configuration with respect to lid 330, gasket 384 coupled lid cover 380 disengages with vent 354 and as a result gasket 384 is within pocket 366, thereby providing fluid communication between storage compartment 122 and outside the container 110 via vent 354. In various embodiments, lid 330 and/or lid cover 380 includes a bumper 386 that facilitates decelerating lid cover 380 with respect to lid 330 when lid cover 380 is being closed or opened, thereby reducing amount of liquid splashing.

It should be understood that the figures illustrate the exemplary embodiments in detail, and it should be understood that the present application is not limited to the details or methodology set forth in the description or illustrated in the figures. It should also be understood that the terminology is for description purposes only and should not be regarded as limiting.

Further modifications and alternative embodiments of various aspects of the disclosure will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one. As used herein, "rigidly coupled" refers to two components being coupled in a manner such that the components move together in a fixed positional relationship when acted upon by a force.

Various embodiments of the disclosure relate to any combination of any of the features, and any such combination of features may be claimed in this or future applications. Any of the features, elements or components of any of the exemplary embodiments discussed above may be utilized alone or in combination with any of the features, elements or components of any of the other embodiments discussed above.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A drinking container comprising:

a bottom panel that defines a bottom-most surface;

an axis around which the bottom panel is centered;

a wall extending upwardly from the bottom panel, the wall extending around the axis, the wall and bottom panel collectively partially defining a storage compartment, the wall defining an upper opening opposite the bottom panel;

a lid coupled to the wall and partially covering the upper opening, the lid defining a drinking opening smaller than the upper opening, the lid comprising a first projection that extends upward away from the bottom panel, wherein the first projection extends circumferentially around and is centered on the axis;

a lid cover rotatably engaged with the lid, wherein when the lid cover is in a closed position the lid cover occludes the drinking opening, and when the lid cover is in an open position the drinking opening provides fluid communication between the storage compartment and an exterior of the drinking container, the lid cover comprising a first recess circumferentially extending around the axis, wherein the first recess receives the first projection; and a biasing element coupled to at least one of the lid and the lid cover, the biasing element biasing the lid cover from transitioning from the closed position to the open position with respect to the lid.

2. The drinking container of claim 1, the lid comprising a second projection distinct from the first projection and that extends upward away from the bottom panel, wherein the second projection extends circumferentially around and is centered on the axis, and the lid comprising a second recess circumferentially extending around the axis, wherein the second recess receives the second projection.

3. The drinking container of claim 1, the lid comprising an upper wall extending perpendicular to the axis, wherein the first projection extends upward from the upper wall.

4. The drinking container of claim 3, the lid comprising a second wall extending upward from the upper wall away from the bottom panel, the second wall defining an inner surface that faces inward towards the axis.

5. The drinking container of claim 1, the biasing element comprising:

a first magnetically-responsive element coupled to the lid; and a second magnetically-responsive element coupled to the lid cover, wherein magnetic engagement between the first magnetically-responsive element and the second magnetically-responsive element biases the lid cover from transitioning from the closed position to the open position with respect to the lid.

6. The drinking container of claim 5, wherein the second magnetically-responsive element comprises a first magnet.

7. The drinking container of claim 6, wherein the first magnetically-responsive element comprises a second magnet.

8. The drinking container of claim 5, comprising a third magnetically-responsive element coupled to one of the lid cover or the lid, wherein magnetic engagement between the third magnetically-responsive element and one of the first magnetically-responsive element and the second magnetically-responsive element biases the lid cover from transitioning from the open position to the closed position.

9. The drinking container of claim 8, wherein the third magnetically-responsive element is coupled to the lid.

10. The drinking container of claim 1, wherein the lid cover comprises a body that extends circumferentially around the axis, and a second projection that extends from the body towards the axis, wherein the lid comprises a second recess that receives the second projection.

11. The drinking container of claim 10, wherein the second recess extends circumferentially around the axis.

12. The drinking container of claim 1, the lid comprising a second projection extending inwardly from the lid towards the axis, wherein engagement between the second projection and the lid cover biases the lid cover towards the bottom panel.

13. A drinking container comprising:

a bottom panel that defines a bottom-most surface;

an axis around which the bottom panel is centered;

a wall extending upwardly from the bottom panel, the wall extending around the axis, the wall and bottom panel collectively partially defining a storage compartment, the wall defining an upper opening opposite the bottom panel;

a lid coupled to the wall and partially covering the upper opening, the lid defining a drinking opening smaller than the upper opening, the lid defining an inner surface that faces inward towards the axis;

a lid cover rotatably coupled to the lid, the lid comprising an outer surface that faces outward away from the axis, the outer surface and inner surface facing towards each other, the lid cover actuating between an open position and a closed position with respect to the lid, wherein when the lid cover is in the closed position the lid cover occludes the drinking opening, and when the lid cover is in the open position the drinking opening provides fluid communication between the storage compartment and an exterior of the drinking container, wherein the outer surface and the inner surface do not interface when the lid cover is rotated with respect to the lid; and a biasing element coupled to at least one of the lid and the lid cover, the biasing element biasing the lid cover from transitioning from the closed position to the open position with respect to the lid.

14. The drinking container of claim 13, the lid comprising a first projection that extends upward away from the bottom panel, wherein the first projection extends circumferentially around and is centered on the axis, and the lid cover comprising a first recess circumferentially extending around the axis, wherein the first recess receives the first projection.

15. The drinking container of claim 14, the lid comprising an upper wall extending perpendicular to the axis, wherein the first projection extends upward from the upper wall.

16. The drinking container of claim 15, the lid comprising a second wall extending upward from the upper wall away from the bottom panel, the second wall defining the inner surface that faces inward towards the axis.

17. The drinking container of claim 13, the lid comprising an upper wall extending perpendicular to the axis, and a second wall extending upward from the upper wall away from the bottom panel, the second wall defining the inner surface that faces inward towards the axis.

* * * * *